US005419006A

United States Patent [19]

Duthie

[11] Patent Number: 5,419,006

[45] Date of Patent: May 30, 1995

[54] EXHAUSTER FAN SYSTEMS

[75] Inventor: Anthony J. Duthie, Horsham, United Kingdom

[73] Assignee: Johnston Engineering Limited, Surrey, United Kingdom

[21] Appl. No.: 162,775

[22] Filed: Dec. 8, 1993

[30] Foreign Application Priority Data

Mar. 23, 1993 [GB] United Kingdom ..... 9305973

[51] Int. Cl.[6] ..... E01H 1/08

[52] U.S. Cl. ..... 15/339; 15/326; 15/347; 15/412

[58] Field of Search ..... 15/319, 339, 412, 340.1, 15/347, 340.3, 340.4

[56] References Cited

U.S. PATENT DOCUMENTS 4,356,589 11/1982 Mealing et al. ..... 15/412 X
4,370,776 2/1983 Kullik ..... 15/319
4,399,585 8/1983 Kullik et al. ..... 15/319
4,555,826 12/1985 Rodgers et al. .
4,773,119 9/1988 Duthie et al. ..... 15/412 X

FOREIGN PATENT DOCUMENTS 580983 9/1946 United Kingdom .
1079857 8/1967 United Kingdom .

*Primary Examiner*—Christopher K. Moore
*Attorney, Agent, or Firm*—Young & Thompson

[57] ABSTRACT

An exhauster fan system for a road sweeping machine comprises a rotatable fan, a drive, and a hydrostatic transmission system coupled between the drive and a spindle on which the fan is mounted. The output of the transmission system is controlled to apply a constant torque to the fan spindle. The transmission system comprises a variable displacement pump coupled to drive a fixed displacement motor. A pressure control is associated with the pump to control hydraulic oil flow in the pump to sustain a set pressure in the motor. The pressure control is selectively operable to provide different set pressures to the motor for different operating conditions. The fan is used in the environment of a road sweeping vehicle comprising a chassis, an airtight container mounted on the chassis, at least one suction conduit connected to the container and, positioned within the container, the described exhauster fan system in which the fan creates a high velocity air flow within the suction conduit.

5 Claims, 4 Drawing Sheets

EXHAUSTER FAN SYSTEMS

The invention relates to an exhauster fan system used in, but not limited to, road sweeping vehicles of the suction-type and more specifically to a hydrostatic transmission system for driving an exhauster fan.

Many suction-type road sweeping vehicles utilise a centrifugal exhauster fan for their sweeping action. The fan is the means used for generating the air flow in a suction or vacuum-type machine. The fan generates a vacuum within an airtight container mounted on the vehicle chassis. Debris from the road is initially collected by brush means and positioned adjacent the mouth of one or more suction conduits connected to the container. The vacuum generated by the fan causes a high velocity air flow in the conduits which induces the debris into the conduits mouth and it is sucked through suction conduits and deposited in the container. Once in the container, the debris is separated from the air by means of a separation system, and the air flow is exhausted by the fan to the atmosphere.

The drive means used to drive the fan may be purely mechanical, or hydrostatic by way of fixed displacement pump and motor combinations or a variable displacement pump with a fixed displacement motor combinations.

In existing sweeping machines, the maximum duty of the exhauster fan is set by the maximum speed, which is often the normal operating speed, at which the prime moving engine can drive it. The prime mover engine is therefore normally selected so as to be able to drive the fan at a speed whereby it is expected to consume the maximum volume of air. The fan is therefore usually driven at a constant speed.

Where a variable displacement pump is used, it is necessary to include means to control the flow of fluid to control the fan motor at a fixed operating speed.

One of the characteristics of such suction-type sweeping machines, is that the power requirement of the fan, when running at a set speed, is at its greatest when the least amount of debris is being conveyed. This condition arises when the fan is handling its maximum duty of air. Once debris is entrained in the air, the air flow is consequentially impeded by the debris entering the nozzle such that the power requirement falls.

This has the disadvantageous effect that the fans in such machines are not used efficiently in terms of power consumption and they tend to produce excessive noise emission at maximum air flow when least work is being effected.

It is an object of the present invention to overcome these disadvantages and to provide a more efficient exhauster fan system.

According to the present invention there is provided an exhauster fan system for a road sweeping machine comprising a rotatable fan, drive means and a hydrostatic transmission system coupled between the drive means and a spindle on which the fan is mounted the output of which transmission system is controlled to apply a constant torque to the fan spindle.

A specific embodiment of the invention will now be described, by way of example only, with reference to the accompanying drawings, in which.

Figure 1:
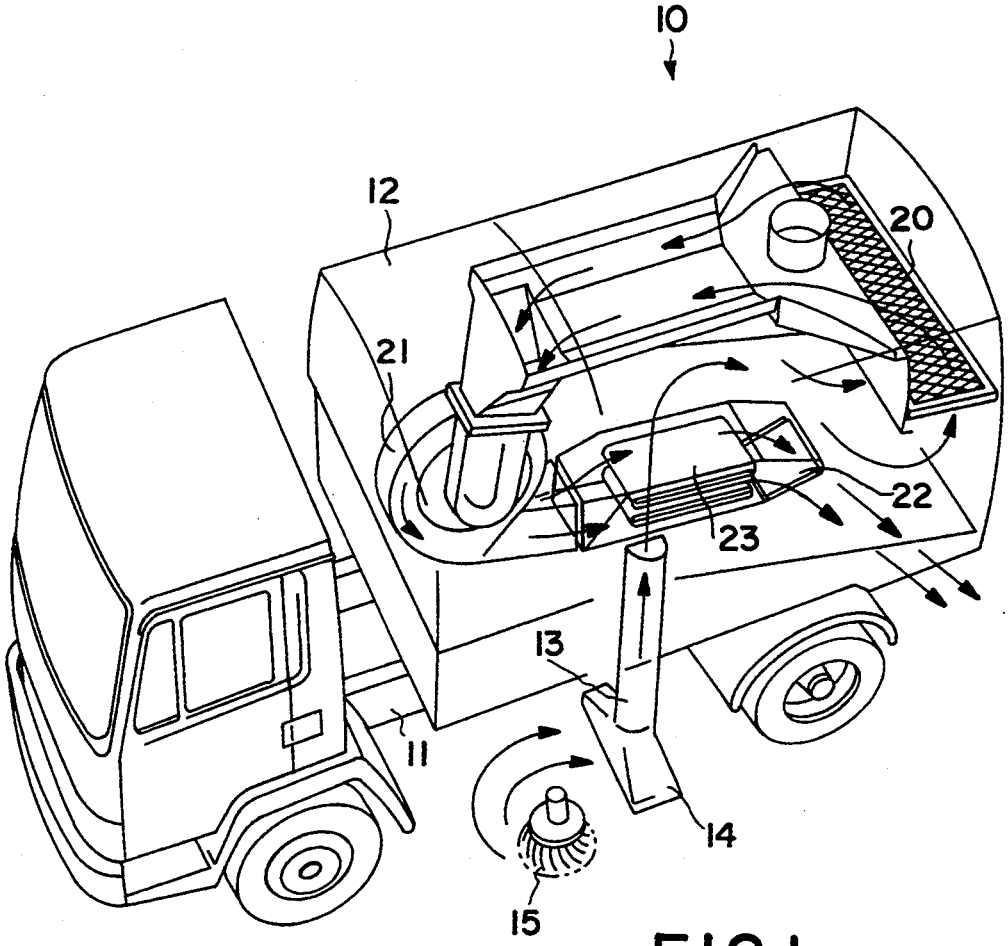
FIG. 1 is a schematic perspective view of a typical road sweeping vehicle, with parts omitted for clarity.

Referring to FIG. 1, a typical road sweeping machine 10 comprises a vehicle chassis 11 on which is mounted an airtight container 12. Attached to the airtight container 12 are a pair of suction conduits 13 (only one of which is shown) having an inlet nozzle 14 at the free end thereof. Located adjacent the inlet nozzles are a pair of rotatable sweeping brushes 15, (only one of which is shown) for positioning debris at the mouth of the nozzle 14.

Positioned within the airtight container 12 is a filter 20 which separates debris from the air flow passing through the container, an exhauster fan 21 for creating a vacuum in the container 12 and consequently the circulating air flow and an air discharge outlet 22. Located between the exhauster fan 21 and the discharge outlet 22 is a noise attenuator 23 which assists in reducing the noise emission from the sweeper machine 10. The direction of the air flow is shown by the arrows in FIG. 1, which passes up through the conduits 13 into the container 12, circulates through the filter before being discharged to atmosphere.

Figure 2:
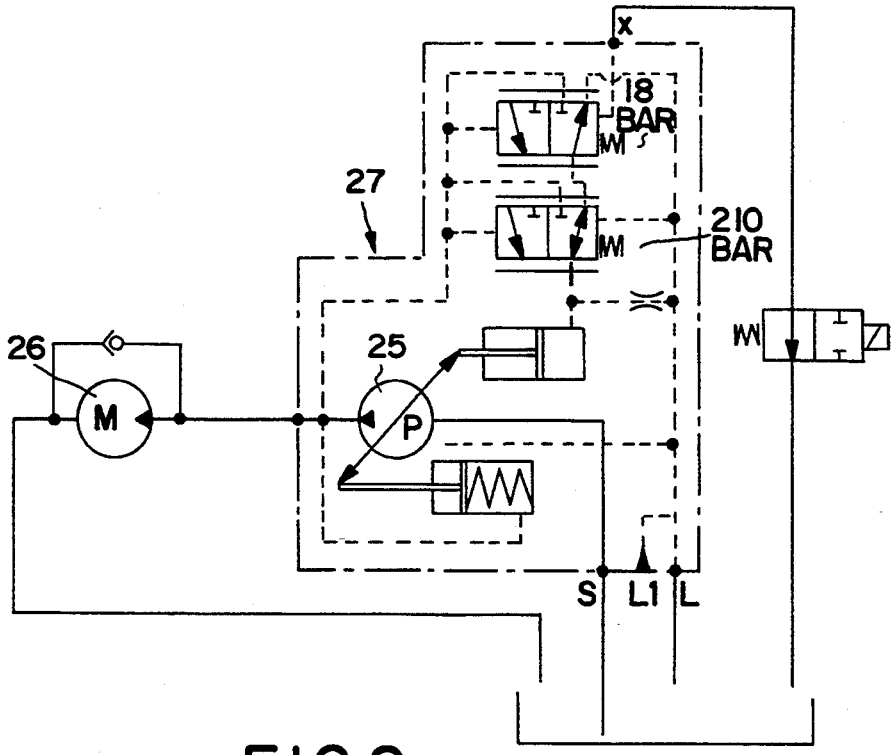
FIG. 2 is a diagramatic representation of the hydraulic system circuit for controlling the fan of the present invention.

The exhauster fan 21 is driven by an engine via the hydrostatic transmission system illustrated in FIG. 2. The engine (not shown) is coupled to a hydraulic pump 25, which in turn drives hydraulic motor 26 which is coupled to the fan 21. The pump 25 is of the variable displacement type and the motor 26 of the fixed displacement type.

As shown in FIG. 2, the pump 25 is controlled by a pressure compensation system 27 which is of a known type and which controls the hydraulic oil flow to sustain a set pressure in the driven element, i.e. the motor 26. As the pressure output of the motor is proportional to the output torque requirement, the effect of this is that a constant torque is applied to the spindle of the exhauster fan 21. The result of this is that the rotational speed of the fan 21 varies according to the volume of air being consumed, which in turn varies depending on the resistance caused by the swept debris entering the nozzle 14. With a high resistance, such as when the air flow is greatly restricted, the torque requirement of a fixed speed fan is consequently lower. Under such circumstances, with the system according to the present invention, the speed of the exhauster fan 21 will increase to a higher speed until the torque and thus the maximum hydraulic pressure is again reached, or the maximum output flow of the pump is reached.

The pressure (P) generated by a fan within a system varies with the ratio of the speed squared according to the following formula:

$$P_2 = P_1(rpm_2/rpm_1)^2$$

where $P_2$ = pressure at $rpm_2$ $P_1$ = pressure at $rpm_1$

Thus, as the speed increases, this in effect generates a much higher fan pressure and resultant air flow than in the prior art systems which have fixed speed fans, with the result that any blockages occurring from heavy sweeping conditions are much more easily cleared by the shear force of this higher pressure and air flow characteristic.

The invention therefore differs from the prior art systems in that the power input increases during 10 heavy sweeping conditions whereas under such conditions in prior art systems it decreases. This is explained by the fact that because a constant torque is applied to the fan spindle, an increase in speed represents a proportional increase in the power input according to formula:

$$\text{POWER} = \text{TORQUE} \times \text{SPEED}$$

In the prior art systems, with the fan running at a set speed, the torque requirement falls under heavy sweeping conditions due to the air flow restriction. Accordingly the power input to the fan also falls, when in fact the maximum force is needed to break the blockage.

The inertia of the fan impeller is also designed to be higher than in the known prior art systems, so that energy can be "stored" within it during the high speed phase which can be used to purge any blockages as the stored energy is liberated during the prolonged slowing-down process once the higher fan pressure has overcome the initial blockage resistance.

Figure 3:
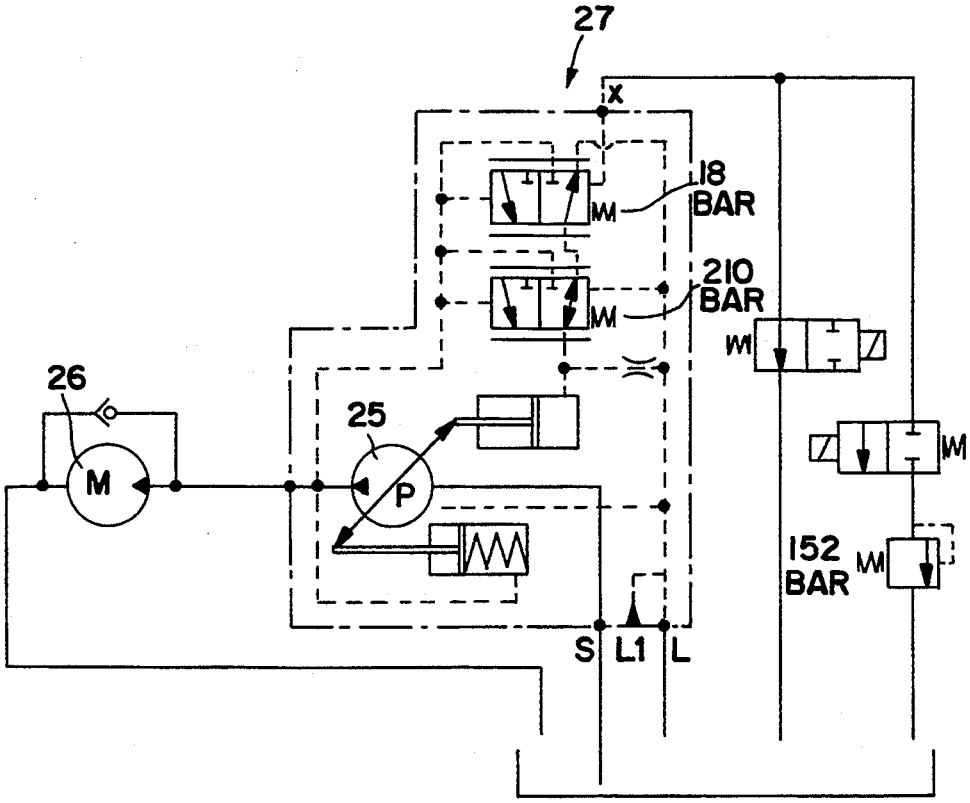
FIG. 3 shows a diagramatic representation of a modified hydraulic system circuit.

In a modified embodiment of the invention, there is provided a control system in which the input torque to the motor 26 is selectively set by controlling the hydraulic pressure. This is illustrated in FIG. 3 which shows a system where two modes of operation are provided. The pressure is controlled within the pump to 225 bar and by a supplementary external control 30 to 180 bar for lighter sweeping duties.

Figure 4:
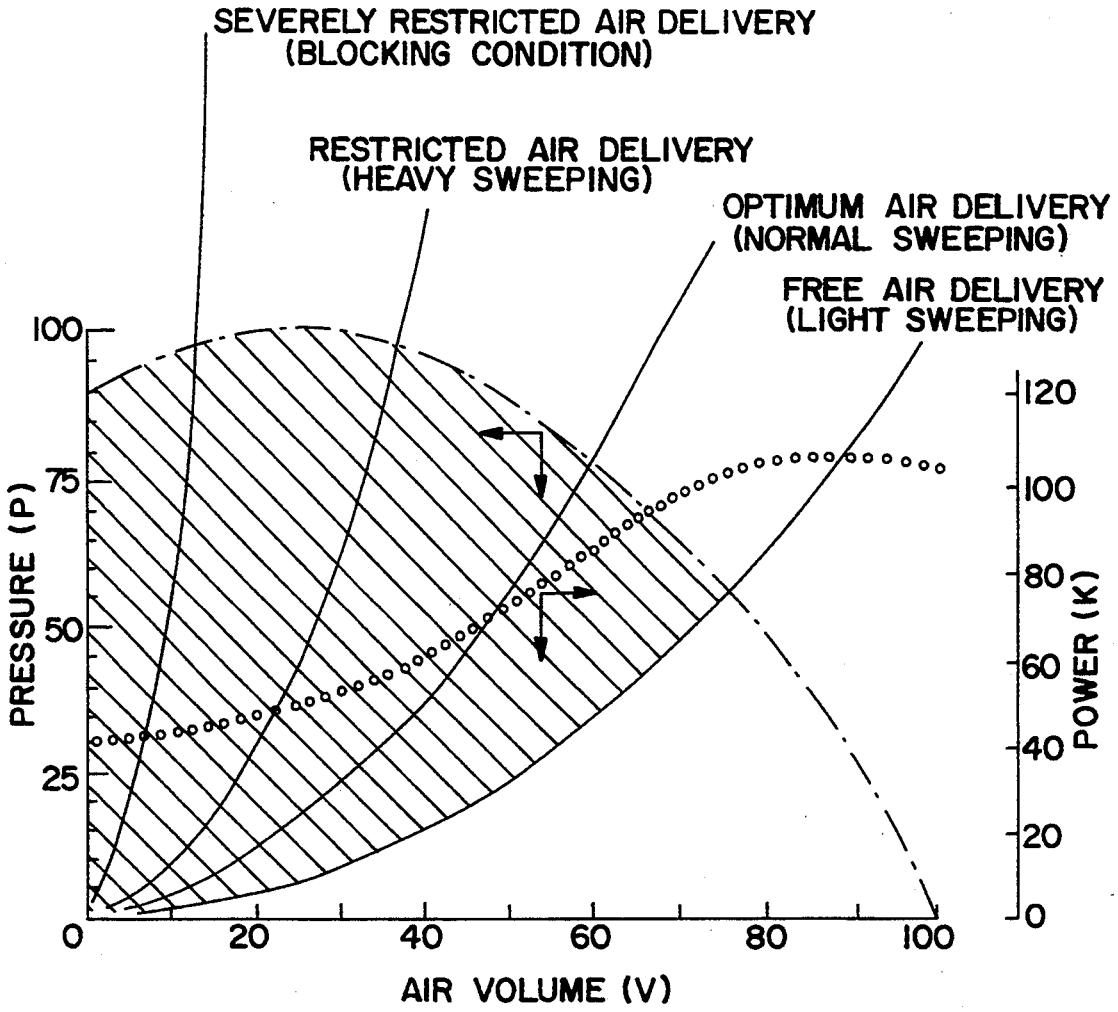
FIG. 4 shows the typical operating and power characteristics of a fan commonly used in prior art suction sweeping machines.

FIG. 4 shows the typical operating and power characteristics of a "backward bladed" fan commonly used in prior art suction sweeping machines. Such a fan typically has 9 blades of 640 mm diameter, and the hydraulic system comprises a motor having a displacement of 28 cc/rev and a pump operable at a speed of 2500 rpm with a maximum displacement of 45 cc/rev. Obviously the specifications of the fan, pump and motor will vary according to the requirements of the systems. The diagram also shows the normal zone of operation within the maximum and minimum air flow expectations.

Figure 5:
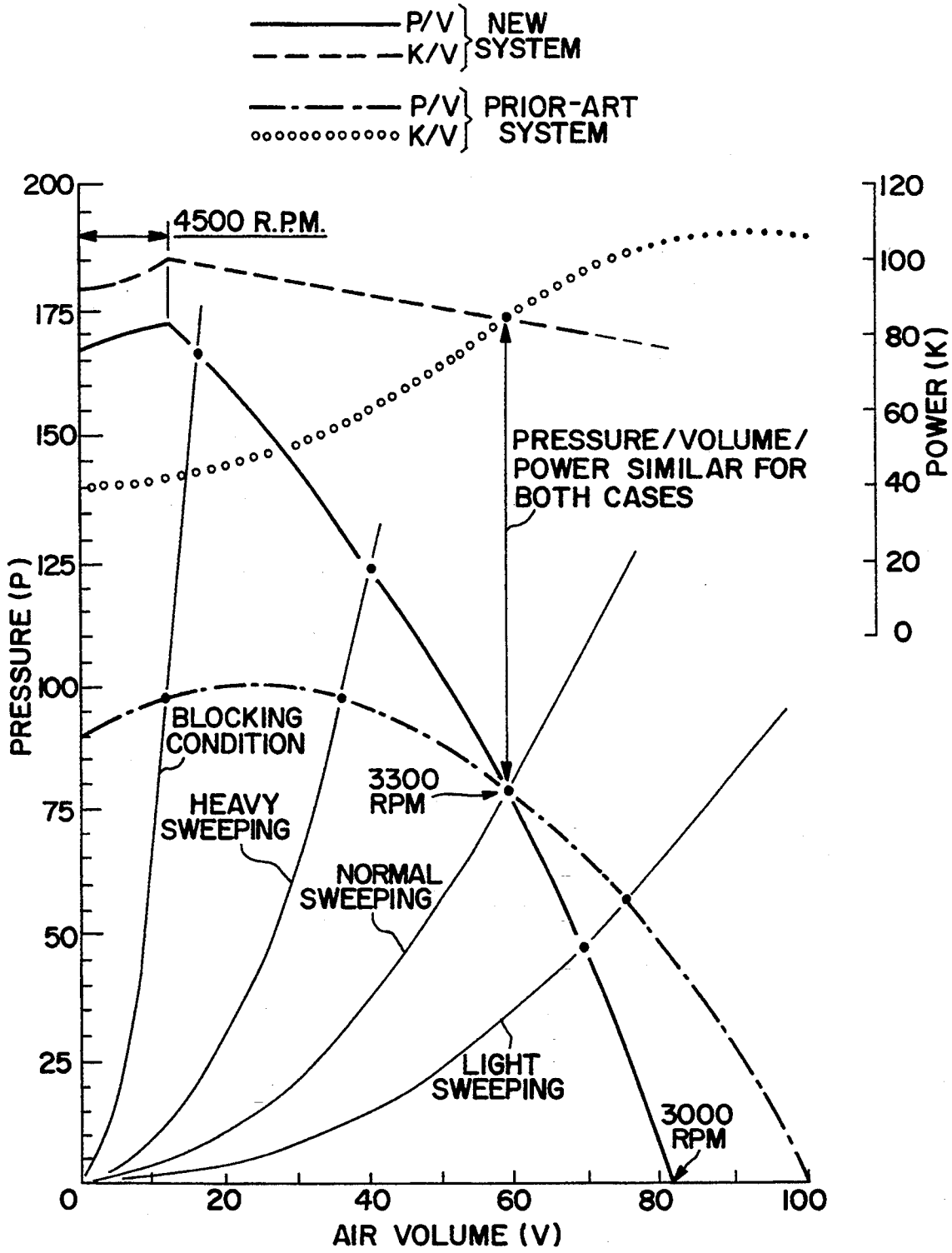
FIG. 5 shows a comparison of the performance characteristics of the system of the present invention against the prior art system depicted in FIG. 4.

For comparison purposes, FIG. 5 also shows the fan performance characteristics of a prior art system against a system according to the invention using basically a similar type and size of fan impeller running at a set speed. Both systems work within the constraints of a similar maximum power input, although ultimate power requirements are decided according to the required performance criteria. FIG. 5 clearly shows that in the system according to the present invention, the ultimate pressure input is considerably higher than that of the prior art system. The maximum power utilisation of the two systems is similar, but appearing at different points. The maximum air volume shown in the system according to the invention is less than that of the prior art system, although in realistic terms this is an artificial criteria as it only occurs in the lightest of sweeping duties and is therefore not a useful characteristic.

The invention has a further major benefit concerning noise generation from the fan system. From experimental work and published data it is generally known that one of the major noise sources of suction sweeping machines results from the air movement within and from the air conveyance system. Basically maximum noise emission occurs at maximum air flow, a condition met only in very light sweeping conditions in prior art systems.

In the system according to the present invention, the fan type, size and motor are selected such that under light sweeping conditions, when the torque requirement is high, the fan would run at a correspondingly lower speed than in the prior art system with a resultant lower noise emission. Suction performance under normal sweeping conditions, however, would be similar in both the prior art and inventive system as the fans in each would both run at similar speeds and the power inputs (assuming the same type and size of fan).

A further advantage of the present invention is concerned with the density of the air, which can effect the performance of the sweeping machines. In the prior art machine with the fan impeller running at a constant speed, the pressure (the "static pressures" within the system or the "velocity head pressure" in the conveying system) varies proportionally with the air density. Air density can vary with altitude and climatic conditions (barometric pressure, temperature and humidity). In other words, the suction performance capability of prior art sweeper machines is better on a cold day at low altitude when the air is dense in comparison to hot weather at high altitude when it is less dense. Because the air density can vary, the power input to the fan running at a constant speed will also vary, requiring more power as the air density increases.

In the system according to the invention, because the driving torque to the fan impeller is constant, in less dense air conditions the fan will increase to a higher speed so maintaining principally a constant suction performance irrespective of air density.

To summarise, there are numerous advantages relating to the present invention compared to the prior art systems where the fan is set to run basically at a constant speed. These include a potential noise emission being reduced by the fact that the fan runs slower when debris is not being ingested into the pick-up conveyance system; the power requirement, and hence fuel consumption, is reduced in light sweeping duties; the power is automatically applied to the fan in the heavy sweeping conditions, contrary to a reduction in power as in the prior art systems; the system is cognisant to air density, so maintaining a constant performance criteria in respect of varying barometric conditions, whether from altitude or temperature; the variable output pump can be selected so that the maximum speed capability is far in excess of those used in the prior art systems using similar design characteristics, for example 1.4 times greater.

I claim:

1. An exhauster fan system for a road sweeping machine comprising a rotatable fan, drive means, a hydrostatic transmission system coupled between the drive means and a spindle on which the fan is mounted, the output of which transmission system is controlled to apply a constant torque to the fan spindle.

2. An exhauster fan system as claimed in claim 1 in which the transmission system comprises a variable displacement pump coupled to drive a fixed displacement motor.

3. An exhauster fan as claimed in claim 2 further comprising pressure control means associated the pump to control hydraulic oil flow in the pump to sustain a set pressure in the motor.

4. An exhauster fan system as claimed in claim 3 in which the pressure control means are selectively operable to provide different set pressures to the motor for different operating conditions.

5. A road sweeping vehicle comprising a chassis, an air-tight container mounted on the chassis, at least one suction conduit connected to the container and, positioned within the container, an exhauster fan system as claimed in claim 1 in which the fan creates a high velocity air flow within the suction conduit.

* * * * *